United States Patent [19]

Murphy

[11] 4,190,975

[45] Mar. 4, 1980

[54] ADVERTISING OR NOVELTY DEVICE

[76] Inventor: Kent D. Murphy, 4716 Bradley Blvd., Apt. T-6, Chevy Chase, Md. 20015

[21] Appl. No.: 864,084

[22] Filed: Dec. 23, 1977

[51] Int. Cl.[2] ..... G09F 3/00

[52] U.S. Cl. ..... 40/2 A; 40/501; 46/145; 272/8 N

[58] Field of Search ..... 40/2 R, 2 A, 27.5, 501, 40/330; 46/145, 146; 272/8 N

[56] References Cited

U.S. PATENT DOCUMENTS

| | | | |
|---|---|---|---|
| 944,744 | 12/1909 | Pine | 40/323 |
| 3,056,220 | 10/1962 | Nelson | 272/8 N |

*Primary Examiner*—John F. Pitrelli

*Assistant Examiner*—G. Lee Skillington

*Attorney, Agent, or Firm*—Brady, O'Boyle & Gates

[57] ABSTRACT

Two spaced apart, generally flat, outer members have a connector connecting them together at their centers. A third member having at least one segment portion connected thereto by resilient inwardly biasing members is positioned in the space between the outer members and has an inclined surface on at least one side thereof mating with a complimentary inclined surface on one of the outer members, whereby squeezing the outer members together at their perimeters adjacent the segment portion causes the segment portion to extend outwardly from the perimeters of the outer members and the connector, and to retract when the squeezing pressure is removed.

24 Claims, 7 Drawing Figures

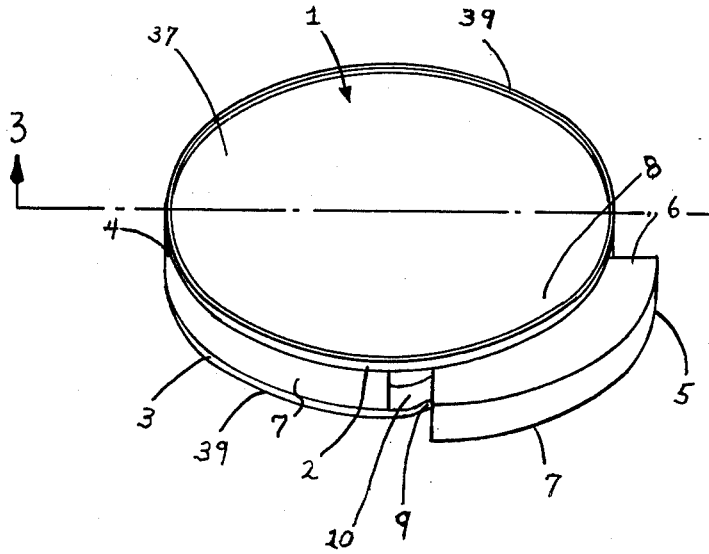
FIG. 1
FIG. 2
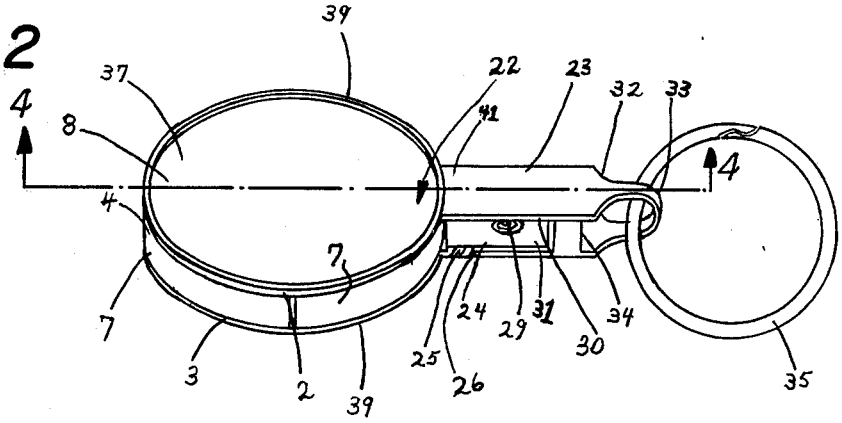

ADVERTISING OR NOVELTY DEVICE

Cost consciousness, or thrift, is a timeless theme which is advocated by some, ignored by others, but practiced in some manner by most. The term, "pinch penny," is a ubiguitous term for thrift.

The level of popularity, and practice, of this theme in any given time period is correlated to the general condition of the economy during said period. When economic conditions are bad, cost consciousness increases in popularity, as it then becomes a necessity in order for individuals to maintain or increase their level of prosperity. Likewise, when prices increase substantially for ordinary consumer goods, the consumer becomes more cost conscious in his choice of products.

Advertising programs for commercial enterprises, as well as for political organizations and campaigns and other organizations, try to exploit popular themes and public moods, and give away items, bearing advertising indicia, are used frequently as part of both specific advertising programs and general advertising activities. When economic conditions or high product prices make the consumer cautious, advertising attempts to enhance the image of value for its subjects, and to portray said subjects' producers or backers as being value and cost conscious and interested in satisfying the consumers' desire for value and thrift. Give away items may convey thrift by advertising indicia to this effect, and they also intrinsically convey the idea of value by virtue of being free, and thus being added value to an existing product at an existing price. Retention of the item, and the indicia thereon, conveys the ideas of thrift and value repeatedly.

One of the objects of this invention is to provide an advertising device to convey the themes of thrift and value for advertising purposes in such a manner that attracts attention, piques the imagination, and invites repeated handling, thus repeatedly conveying said themes.

Another of the objects is to provide a novelty device which plays on the strong and varied attitudes associated with the term "pinch penny."

These and other objects and advantages of the present invention will become apparent from a reading of the following description and claims in the light of the accompanying drawings.

SUMMARY

In accordance with this invention generally stated, described herein is an advertising or novelty device comprised of three pieces of molded, flexible plastic, two outer pieces and one inner piece having one or more segments which slide out when the perimeters of said two outer pieces of said device are squeezed or pinched together. The two outer pieces are snapped together at the center at a connecting post. The segmented inner piece is beveled along one portion of the surface thereof, as is a complimentary mating portion of the inner side of one of said two outer pieces. There is a modification in construction that converts said device into a key ring attachable device by integrating into said two outer pieces extensions that snap together, said connected extensions thus forming a loop on a key ring when one extension is placed through said key ring prior to snapping said extensions together.

Embossed on the outer faces of the aformentioned outer pieces may be likenesses of the faces of a U.S. penny or other ornamentation, or advertising indicia. Embossed on the top surfaces of the aforementioned segments of the aforementioned inner piece are advertising indicia or words which appear in view when said segments slide out, and, likewise, disappear from view when said segments retract when the pressure of squeezing or pinching is removed. Advertising indicia or words may also be embossed on outer surfaces of the aforementioned extensions which form the aforementioned key ring loop and also on the segmented surface of the outer periphery of said inner piece.

The selection of ornamentation of the aforementioned faces and of the advertising indicia or words on the aforementioned surfaces establish the advertising or novelty character of the aforementioned device. Humorous, serious, or informative words may be used for the novelty device.

DESCRIPTION OF DRAWINGS

In the drawings:

FIG. 1 is a perspective view of my advertising or novelty device showing one segment of the inner piece extended;

FIG. 2 is a perspective view of my advertising or novelty device as a key ring attachable device;

DETAILED DESCRIPTION

Figure 3:
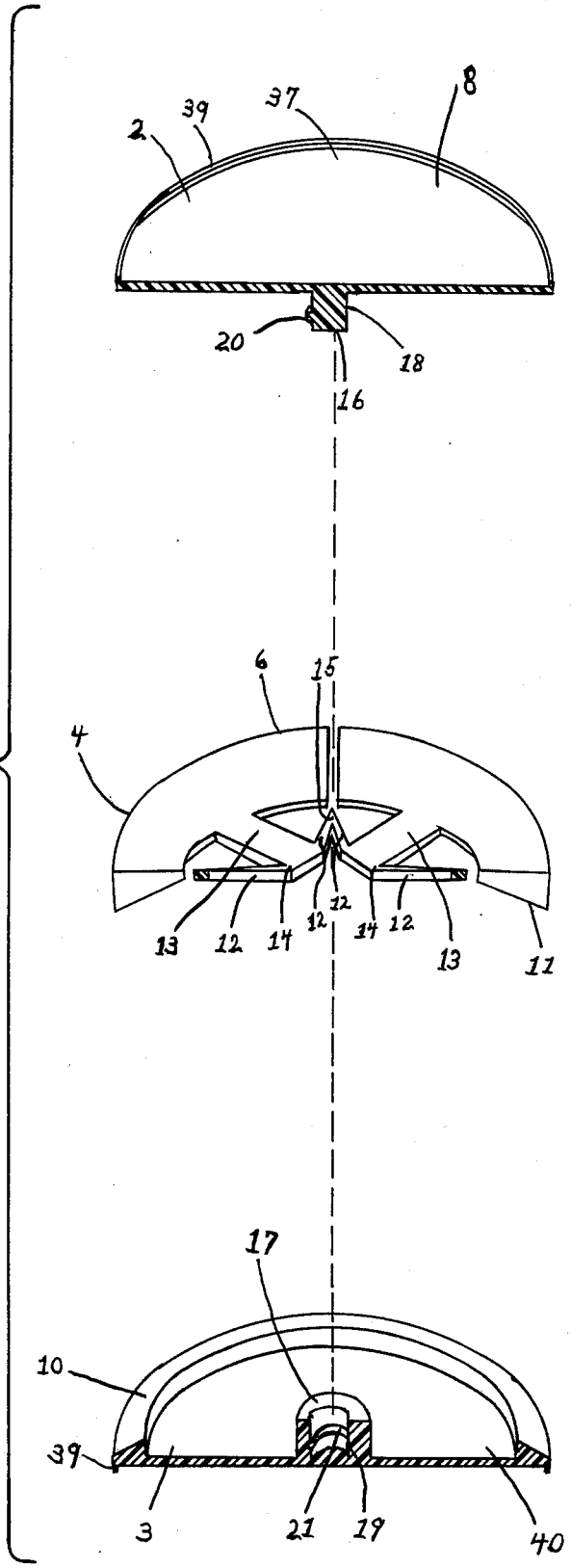
FIG. 3 is an exploded, perspective, sectional view through FIG. 1 and taken along line 3—3 thereof.
Figure 4:
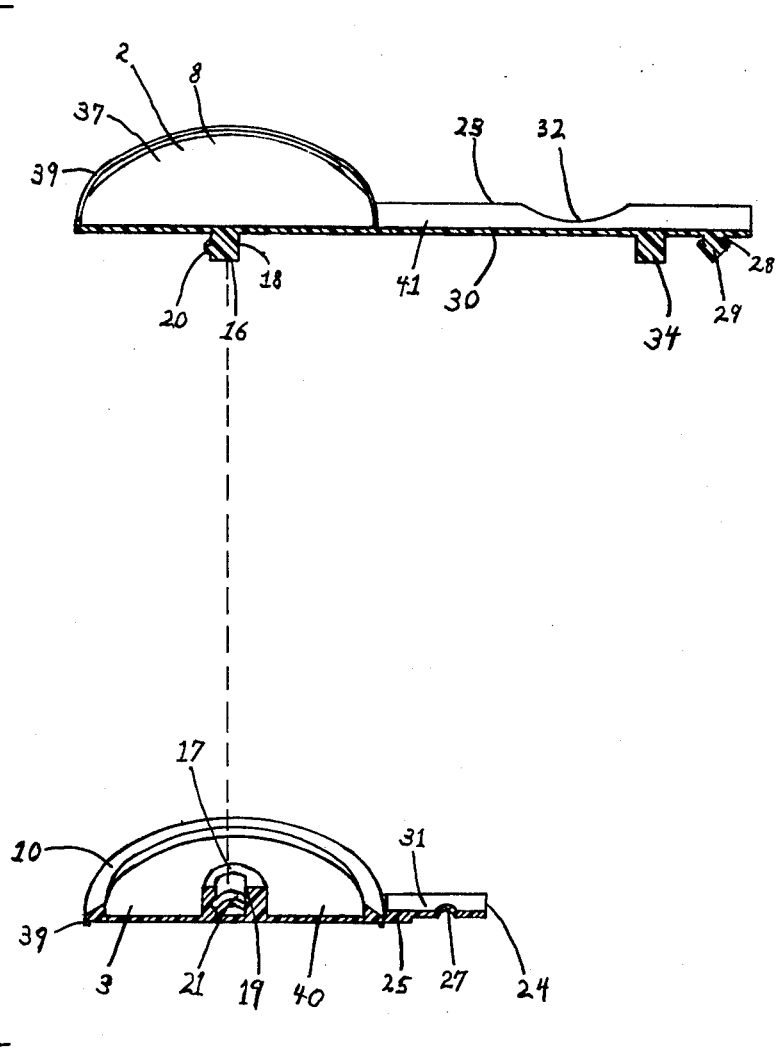
FIG. 4 is an exploded, perspective, sectional view through FIG. 2 and taken along line 4—4 thereof, but with parts omitted for clarity.

Referring to the drawings in greater detail, FIG. 1 illustrates the body of my advertising or novelty device 1 and shows to view the three parts which comprise it, a piece 2 forming the top face 37 of the device 1, another piece 3 forming the bottom face 38 of the device 1, and a third piece 4 which forms the segmented inner piece, and which in FIG. 1 is shown with one segment 5 extended revealing to view the top surface 6 of said extended inner piece segment 5 on which embossed advertising indicia or words may be displayed. Embossed advertising indicia or words may also be displayed on the peripheral surfaces 7 of said segments of said inner piece.

Figure 5:
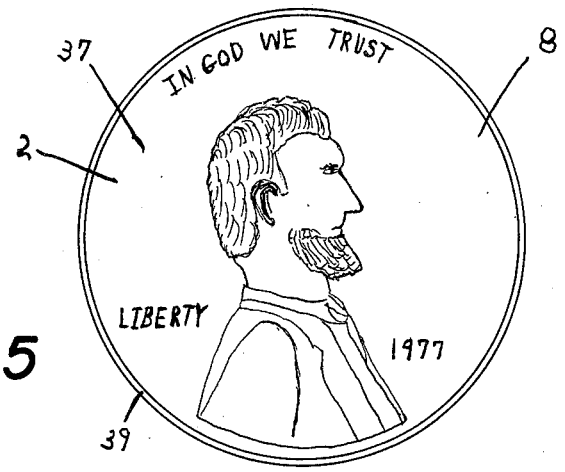
FIG. 5 is a view showing the top face of my advertising or novelty device.
Figure 6:
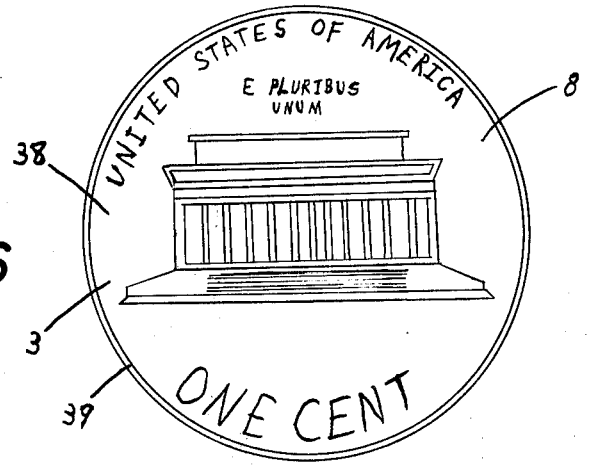
FIG. 6 is a similar view of the bottom face.
Figure 7:
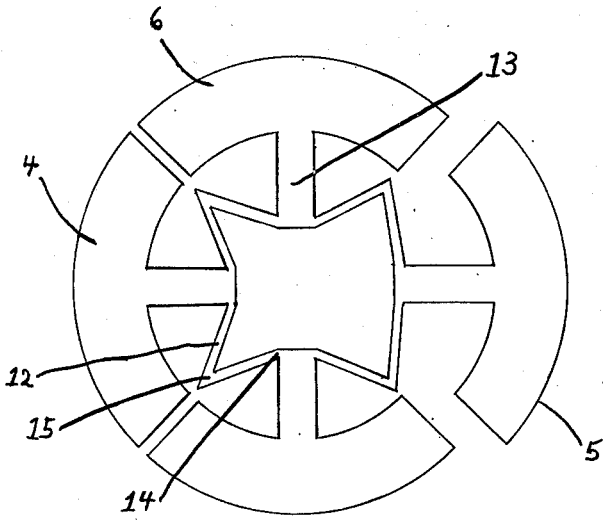
FIG. 7 is a top plan view of the segmented inner piece showing one segment in its extended position.

FIG. 5 and FIG. 6, for purposes of illustration, show one possible ornamentation for the top face 37 and the bottom face 38 of the aforementioned device 1, such being the embossed likenesses of the top face and bottom face of the U.S. penny, respectively; although, in lieu of one or both of said likenesses, other ornamentation or indicia may be embossed on said faces 37 and 38. A raised marginal edge 39, as on a U.S. penny, may be used in instances when the faces 37 and 38 do not bear penny ornamentation, as such raised marginal edges 39 enhance the resiliency of the aforementioned top and bottom pieces 2 and 3, which are made of molded flexible plastic.

Cause for the outward movement extending the aforementioned extended inner piece segment 5 is the pinching together of the aforementioned top and bottom pieces 2 and 3 around their perimeters 8, and the resultant action effected by the bevelled rim 10 around the perimeter of the inner side 40 of said bottom piece 3. The pinching inward 9 of said bevelled or inclined surface rim 10 against the complementary bevelling or inclined surface 11 of the bottom surface of the aforementioned segmented inner piece 4, which is made of flexible resilient plastic, forces said inner piece segment 5 outward, and said outward movement causes the resilient inwardly biasing legs 12, connected to extensions 13 at joints 14 and to like resilient inwardly biasing legs 12 at joints 15, to flex at said resilient biasing joints 14 and 15, thereby permitting said outward movement. Ceasing to pinch said top and bottom pieces 2 and 3 around their perimeters 8 releases the pressure caused therefrom and allows said top and bottom pieces 2 and 3 to resile to their former shapes, and said release of pressure and resiling permits said extended inner piece segment 5 to retract to its former position as a result of reflex action at said resilient inwardly biasing joints 14 and 15, thus concealing the aforementioned exposed surface 6 bear advertising indicia or words.

The aforementioned top and bottom pieces 2 and 3 are permanently joined at their center by cylindrical male 16 and female 17 connectors, respectively extending through the central opening of inner piece 4 adjacent the resilient biasing joints 14. Proper alignment of the aforementioned ornamentation or indicia on the top face 37 with respect to that on the bottom face 38 is accomplished by one side 18 of said male connector being flat, and, likewise, one side 19 of said female connector being correspondingly flat, thus permitting only one alignment when connecting said top and bottom pieces 2 and 3. Permanence of said connection is accomplished by a flange 20 which circumscribes the cylindrical surface of said male connector 16 and which fits into a corresponding notch 21 in said female connector 17, thus rendering disengagement of said connection extremely difficult once said connectors 16 and 17 have been snapped together.

The drawing in FIG. 2 illustrates the aforementioned device 1 in FIG. 1 modified in construction so as to convert said device 1 into a key ring attachable device 22. Such modification is effected by integrating into the manufacture of said device 1 key ring loop extensions 23 and 24 of a thickness approximating that of the aforementioned top and bottom pieces 2 and 3 from which they extend, except where said bottom extension 24 is of a double thickness 25 so as to provide strength and to permit said top extension 23 to join with said bottom extension 24 in such manner as to make the resulting juncture flush on the outer surface 26. Connection of said top and bottom piece extensions 23 and 24 is accomplished by a hole 27 in said bottom piece extension 24 into which is inserted a cylindrical projection 28 of a diameter very slightly less than that of said hole 27 and a length very slightly greater than the thickness of said bottom piece extension 24, and which has at its end a head 29 of a diameter slightly greater than that of said hole 27 and of a height which, in addition with said excess of the length of said cylindrical projection 28 over the thickness of said bottom piece extension 24, is less than the distance between the inner side 30 of said top piece extension 23 and the inner side 31 of said bottom piece extension 24, such that when said cylindrical projection 28 is placed into said hole 27, said head 29 precedes it, apex first, fitting through by virtue of the flexibility of the material of which said device 22 is constructed, and thus effects a permanent connection as a result of said diameter of said base of said head 29 being greater than that of said hole 27.

The width of the aforementioned top piece extension 23 is concave 32 for a portion of its length such that when said top piece extension 23 is bent back, as seen in FIG. 2, to effect the aforementioned connection of both extensions 23 and 24, said bending of said top piece extension 23 is done at said portion of said extension 23 which is concavo-concave 32, thereby providing both maximum flexibility for said bending and also a loop 33 much narrower than said top piece extension 23 so as to facilitate the attachment of the key ring attachable device 22 to a key ring 35.

A key ring restraint 34 across the width of the aforementioned top piece extension 23, at a position on and of a height from said extension 23 such that when said extension 23 is bent over to effect the aforementioned loop 33 said key ring restraint 34 is aligned against the aforementioned bottom piece extension 24 when said extensions 23 and 24 are connected in the aforementioned manner and that the top of said key ring restraint 34 is aligned against the inner side 30 of said top piece extension 23 when said connection is made, serves the purpose of restricting movement of the aforementioned key ring 35 to said narrow loop 33 and of stabilizing said connection of said extensions 23 and 24 by limiting the possible twisting of said extensions 23 and 24 at said connection.

Words or advertising indicia may be embossed on the outer side 41 of the aforementioned top piece extension 23.

The aforementioned key ring 35 is of a type generally commercially available.

While I have illustrated and described two preferred embodiments of the present invention, it will be understood, however, that various changes and modifications may be made in the details thereof without departing from the scope of the invention as set forth in the appended claims.

Having thus described the invention, what is claimed as new and desired to be secured by Letters Patent is:

1. An advertising or novelty device comprising, a pair of outer members connected together in spaced relation, at least one inner member positioned said pair of outer members, biasing means connected to normally resiliently bias said inner member into a rest position contained within said pair of outer members, cooperating parts on said inner member and at least one of said outer members, whereby upon squeezing said pair of outer members together, pressure on said cooperating parts moves said inner member laterally outward from said pair of outer members and upon release of squeezing pressure said inner member retracts into said rest position.

2. An advertising or novelty device as set forth in claim 1, in which said pair of outer members are substantially circular in shape.

3. An advertising or novelty device as set forth in claim 1, in which said cooperating parts comprise complementary sliding bevelled surfaces.

4. An advertising or novelty device as set forth in claim 2, in which said pair of outer members are connected together by a centrally disposed connecting post.

5. An advertising or novelty device as set forth in claim 4, in which said biasing means includes a portion restrained on said connecting post.

6. An advertising or novelty device as set forth in claim 2, in which said inner member has an arcuate outer edge substantially in alignment with the edges of said circular pair of outer members.

7. An advertising or novelty device as set forth in claim 6, in which said inner member has an arcuate length spanning only a portion of the edge perimeter of said pair of outer members.

8. An advertising or novelty device as set forth in claim 1, including at least a second inner member similar to said at least one inner member positioned between said pair of outer members and substantially opposite said at least one inner member, and said biasing means connected to normally resiliently bias said second inner member into a rest position contained within said pair of outer members.

9. An advertising or novelty device comprising two outer pieces and one inner piece of flexible, resilient material, connector means connecting said two outer pieces in spaced relation, said inner piece comprised of plural strip like segments positioned between said outer pieces and encompassing said connector means, a bevelled surface portion on one side of each of said segments, a complementing bevelled surface portion on one of said two outer pieces in cooperative engagement with the said bevelled surface portion on each of said segments, extension portions projecting from said plural segments toward said connecting means, legs projecting from opposite sides of said extension portions, said legs of adjacent extension portions being connected thereby linking said segments and forming a single inner piece, whereby squeezing said outer pieces together around their perimeters creates pressure at the cooperating bevelled surface portions causing one or more of said segments to extend outward of said two outer pieces away from said connector means and to retract when said pressure is removed.

10. An advertising or novelty device as set forth in claim 9 in which the other of said two outer pieces having a substantially flat inner surface, and said plural segments having substantially flat surfaces on the side opposite the bevelled surface portions in sliding contact with said substantially flat inner surface of said other of said two outer pieces.

11. An advertising or novelty device as set forth in claim 9 in which said complementing bevelled surface portion is on the inner surface of said one of said two outer pieces and adjacent the perimeter thereof.

12. An advertising or novelty device as set forth in claim 10, including a raised portion on the inner surface of said one of said two outer pieces and extending therearound adjacent the periphery thereof, and said complementing bevelled surface portion being on said raised portion.

13. An advertising or novelty device as set forth in claim 9, including an extension portion projecting outwardly from at least one of said outer pieces and including means adapted for connecting said extension portion to another object.

14. An advertising or novelty device as set forth in claim 9, including first and second extension portions respectively projecting outwardly from said two outer pieces, and means for connecting said first and second extension portions to each other whereby said device can be connected to another object.

15. An advertising or novelty device as set forth in claim 14, in which said first and second extension portions comprise straps integrally connected to said respective two outer pieces, and said means for connecting comprising cooperating connecting components integral with said first and second straps.

16. An advertising or novelty device as set forth in claim 15, in which said first strap has a greater thickness than said second strap and includes a portion of reduced thickness adjacent the end thereof forming a recess on one face thereof, and said second strap having a free end insertable in said recess to form a flush surface connection with said first strap.

17. An advertising or novelty device as set forth in claim 14, in which said first and second extension portions comprise straps, and a portion of at least one of said straps being tapered to form a narrower width portion at the position for connecting said device to another object.

18. An advertising or novelty device as set forth in claim 15, including restraint means connected on at least one of said first and second straps, said first and second straps forming a connecting loop when connected to each other and said restraint means extending laterally of said loop between said first and second straps to restrict the enclosed area of the loop.

19. An advertising or novelty device as set forth in claim 9, in which said plural segments, said extension portions and said legs are disposed in the same plane.

20. An advertising or novelty device as set forth in claim 9, in which said plural segments are arcuate and said extension portions have inner ends terminating adjacent said connector means.

21. An advertising or novelty device as set forth in claim 20, in which the inner ends of said extension portions are disposed in surrounding relation to said connector means.

22. An advertising or novelty device as set forth in claim 9, in which said two outer pieces are circular in shape, said plural segments being arcuate and having outer edges substantially in alignment with the perimeters of said two outer pieces in the retracted position.

23. An advertising or novelty device as set forth in claim 9, in which said connector means is disposed centrally of said two outer pieces.

24. An advertising or novelty device as set forth in claim 9, in which said connected legs of adjacent extension portions converge outwardly to their connections away from said connector means.

* * * * *